US006925765B2

(12) United States Patent
Fay et al.

(10) Patent No.: US 6,925,765 B2
(45) Date of Patent: Aug. 9, 2005

(54) FACING AND FACED INSULATION ASSEMBLY

(75) Inventors: Ralph Michael Fay, Lakewood, CO (US); John Brooks Smith, Littleton, CO (US); Angela Robin Bratsch, Monument, CO (US)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 10/330,704

(22) Filed: Dec. 27, 2002

(65) Prior Publication Data

US 2004/0123539 A1 Jul. 1, 2004

(51) Int. Cl.[7] ..... E04B 1/74
(52) U.S. Cl. ..... 52/407.3; 52/742.12; 428/43
(58) Field of Search ..... 52/407.3, 407.4, 52/404.3, 481.1, 483.1, 489.1

(56) References Cited

U.S. PATENT DOCUMENTS 2,913,104 A * 11/1959 Parker ..... 206/321
3,307,306 A * 3/1967 Oliver ..... 52/409
3,729,879 A * 5/1973 Franklin ..... 52/406.2
4,709,523 A * 12/1987 Broderick et al. ..... 52/506.05
4,952,441 A * 8/1990 Bose et al. ..... 428/121
5,091,235 A * 2/1992 Vergnano ..... 428/192
5,282,914 A * 2/1994 Spendlove ..... 156/227
5,733,624 A * 3/1998 Syme et al. ..... 428/68
5,750,225 A * 5/1998 Petty ..... 428/36.2
6,191,057 B1 * 2/2001 Patel et al. ..... 442/398
6,415,573 B1 * 7/2002 Moulder ..... 52/408
6,551,677 B2 * 4/2003 Weinstein et al. ..... 428/43
6,579,586 B1 * 6/2003 Fay et al. ..... 428/40.1
6,602,809 B1 * 8/2003 Cabrey ..... 442/2
6,641,910 B1 * 11/2003 Bries et al. ..... 428/343
2003/0082387 A1 * 5/2003 Arndt et al. ..... 428/426

* cited by examiner

*Primary Examiner*—Anita M. King
(74) *Attorney, Agent, or Firm*—Robert D. Touslee; Timothy B. Hofmeyer

(57) ABSTRACT

A faced insulation assembly has a facing sheet with a central field portion that overlays and is bonded to a major surface of the insulation layer. The sheet has two lateral tabs that are joined to the central field portion of the sheet along fold lines. The tabs are folded back to overlay the central field portion of sheet. The fold lines may include score lines or weld lines to help maintain the tabs in the folded position for handling. The tabs have tab strips bonded thereto that may be bonded to the tabs by a pressure sensitive adhesive whereby the tabs may be left in the folded position, unfolded for stapling to framing members, or have the tab strips removed for bonding to framing members either in a folded or an unfolded position.

31 Claims, 3 Drawing Sheets

FACING AND FACED INSULATION ASSEMBLY

BACKGROUND OF THE INVENTION

The subject invention relates to a faced insulation assembly, and, in particular, to a faced insulation assembly wherein a facing adhered to an insulation layer includes lateral tabs with tab strips overlaying and bonded to one surface of the lateral tabs. In preferred embodiments of the invention, the tabs strips are bonded to the tabs by a pressure sensitive adhesive whereby: the lateral tabs may be left in the folded position and the blanket press fitted between the framing members; the lateral tabs may be unfolded and stapled to the framing members with the tab strips left on the tabs to increase the integrity of the tabs; or one or both of the lateral tabs may be unfolded, the tab strips removed, and the tabs bonded to the framing members.

Faced insulation assemblies, such as but not limited to faced blankets of glass fiber building insulation in board, roll, or batt form, are typically installed between and secured to framing members (e.g. studs and joists) located in the walls, ceilings, and floors of buildings. Currently, these faced blankets have longitudinally extending lateral tabs that may be secured to the studs by stapling. However, it has been proposed to provide these faced blankets with lateral tabs that are coated with a pressure-sensitive adhesive so that these faced blankets may be secured to the framing members of a building by pressing the pressure-sensitive adhesive coated surfaces of the tabs against the faces of the framing members. The following patents disclose faced blankets that have longitudinally extending lateral tabs with pressure-sensitive adhesive coated surfaces for securing the faced blankets in place.

U.S. Pat. No. 2,913,104, issued to Konrad Parker on Nov. 17, 1959, discloses a fully enclosed insulation batt 14 with lateral tabs 12 having surfaces coated with a pressure-sensitive adhesive. The lateral tabs 12 are adhered to the faced sides of the insulation batt during shipment and storage and may be pressed against the faces of framing members to secure the insulation batt in place.

U.S. Pat. No. 3,307,306, issued to Robert E. Oliver on Mar. 7, 1967, discloses an insulation blanket faced on one major surface. The facing has an edge portion on one side, inward of the edge of the blanket, which is coated with a pressure-sensitive adhesive and covered with a release liner. The facing also has a tab on the opposite side, extending outward from the blanket, that is coated with a pressure-sensitive adhesive and covered with a release liner. The release liners can be removed from the edge portion of the facing on one blanket and the tab on the facing of another blanket. The tab can then be adhered to the edge portion of the adjacent blanket to adhere the blankets together.

U.S. Pat. No. 3,729,879, issued to Andrew T. Franklin on May 1, 1973, discloses an encapsulated insulation blanket with lateral tabs that extend outward beyond the edges of the encapsulated insulation blanket. The tabs have surfaces coated with pressure-sensitive adhesive to secure the insulation blanket to framing members. The pressure-sensitive adhesive coated surfaces of the tabs are covered with release strips that are removed to adhere the tabs to framing members.

U.S. Pat. No. 4,709,523, issued to Thomas B. Broderick et al on Dec. 1, 1987, discloses a faced insulation assembly batt with one or two double-thickness lateral facing flanges that have a surface coated with pressure-sensitive adhesive.

The double-thickness facing flanges, e.g. the double-thickness facing flanges 10*a* and 10*b* of FIGS. 2 to 6, are formed by folding the lateral edge portions of the facing inwardly through 180° and bonding the lateral edge portions to the inside of the facing sheet. A pressure-sensitive adhesive 14 is applied to one surface of each flange and each flange is folded inwardly through 180° and placed in contact with a release strip 16 that is adhered to the inside surface of the facing sheet. In use, the double-thickness flanges are unfolded to expose the pressure-sensitive adhesive, leaving the release strips adhered to the inside surface of the facing sheet, and the faced insulation assembly batt is installed.

Thus, there has remained a need for a faced building insulation, such as the faced insulation assembly of the subject invention, wherein the facing includes lateral tabs that are folded back onto the facing for packaging and handling to prevent the tabs from being damaged and wherein the lateral tabs have tab strips that can be left on the tabs to provide the tabs with greater integrity for stapling so that facing can be made of thinner or less expensive sheet materials. In addition, there has remained a need for a faced building insulation such as the faced insulation assembly of the subject invention wherein the tab strips are bonded to the lateral tabs by a pressure sensitive adhesive. With this structure, when the faced insulation assembly, e.g. a faced resilient glass fiber insulation blanket, of the subject invention is installed between two framing members: the lateral tabs may be left in the folded position and the blanket press fitted between the framing members; the lateral tabs may be unfolded and stapled to the framing members with the tab strips left on the tabs to increase the integrity of the tabs; or one or both of the lateral tabs may be unfolded, the tab strips removed, and the tabs bonded to the framing members thereby giving the installing technician a variety of choices for installing the faced insulation assembly in a manner to best suit the application.

SUMMARY OF THE INVENTION

The insulating layer of the faced insulation assembly of the subject invention may be made of various materials, such as but not limited to, a foam insulation board, a fibrous insulation blanket, multi-layer or single layer foil insulation, or other insulating materials commonly used in faced building insulation. The faced insulation assembly of the subject invention has a facing sheet with a central field portion that overlays and is bonded to a major surface of the insulating layer. The facing sheet has two lateral tabs that are joined to the central field portion of the facing sheet along fold lines. The lateral tabs are folded back to overlay the central field portion of sheet for packaging, shipping, and handling to prevent damage to the tabs. Preferably, the facing sheet is made of a material that will retain a fold when the facing sheet is folded (commonly known as a "dead fold" material). However, if necessary, the fold lines joining the lateral tabs to the central field portion of the sheet may have laser etched or mechanically formed score lines or weld lines to help maintain the lateral tabs in the folded position for packaging, shipping, and handling. The lateral tabs have tab strips bonded thereto that provide the tabs with increased integrity relative to central field portion of the sheet for handling and stapling. The tab strips may be bonded to the lateral tabs by a pressure sensitive adhesive whereby, for installation: the lateral tabs may be left in the folded position; the lateral tabs may be unfolded for stapling to framing members with the tab strips left in place to increase the integrity of the tabs; or one or both of the lateral tabs may be unfolded and the tab strips removed for bonding to framing members.

DESCRIPTION OF THE PREFERRED EMBODIMENTS

Figure 1:
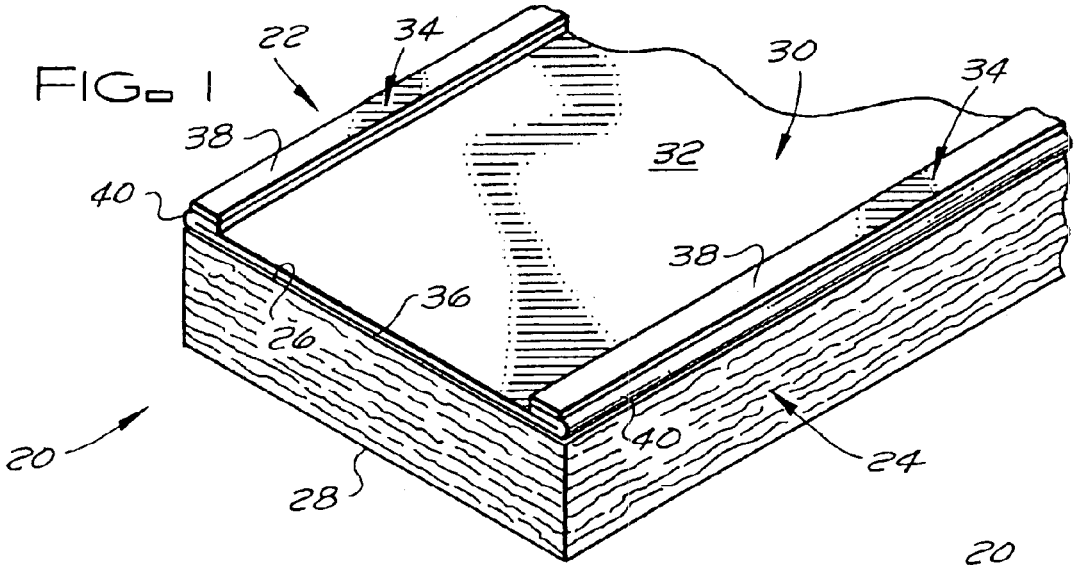
FIG. 1 is a schematic perspective view of a faced insulation assembly of the subject invention.
Figure 2:
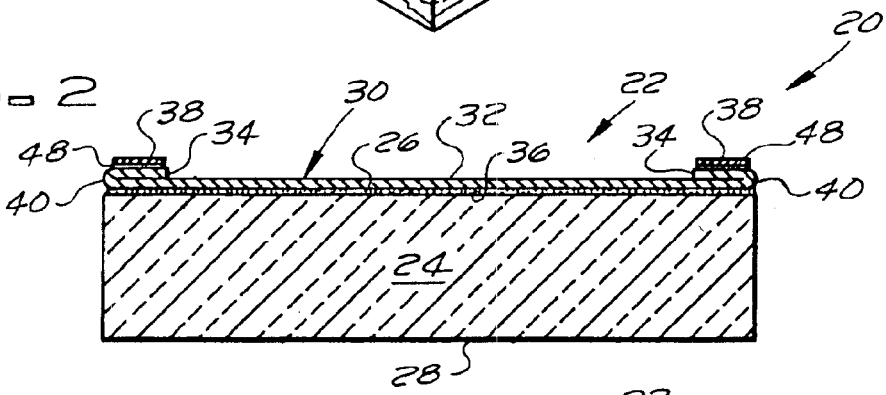
FIG. 2 is a schematic end view of the faced insulation assembly of FIG. 1.

As shown in FIGS. 1 and 2, the faced insulation assembly 20 of the subject invention includes a facing 22 and an insulation layer 24. The insulation layer 24 has first and second major surfaces 26 and 28, which are defined by the length and width of the layer, and a thickness. The facing 22 of the faced insulation assembly 20 is formed by a sheet 30 that has a central field portion 32 and a pair of lateral tabs 34. The central field portion 32 of the sheet 30 overlays and is bonded, typically by an adhesive layer 36, to the major surface 26 of the insulation layer 24. The lateral tabs 34 each have a tab strip 38 that overlays, is coextensive or essentially coextensive with, and is bonded to one surface of the lateral tab. The tab strips 38 provide the lateral tabs 34 with increased integrity relative to central field portion 32 of the sheet 30 for handling and stapling and may be selected to have sufficient integrity to enable the use of thinner and/or less expensive sheet materials for the sheet 30. In addition, the tab strips 38 may also function as release liners overlaying layers or coatings of pressure-sensitive adhesives on the lateral tabs 34 that may be used to secure the lateral tabs 34 to framing members.

Figure 3:
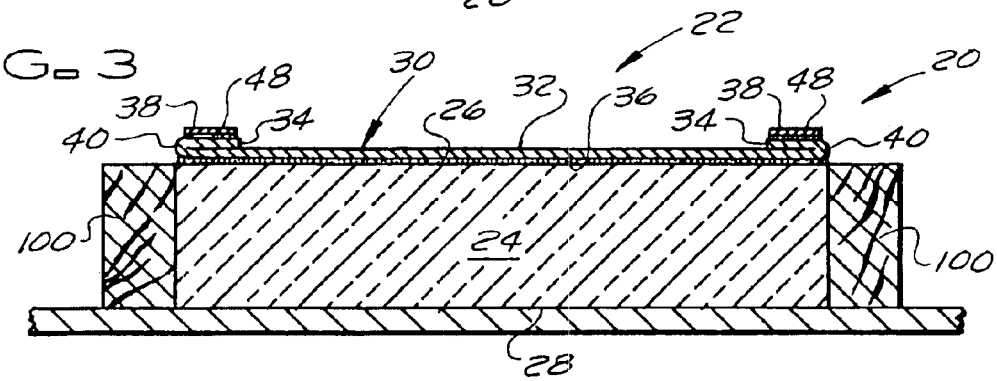
FIG. 3 is a schematic transverse cross section through the faced insulation assembly of FIG. 1 installed between two framing members by press fitting the faced insulation assembly between the framing members.
Figure 4:
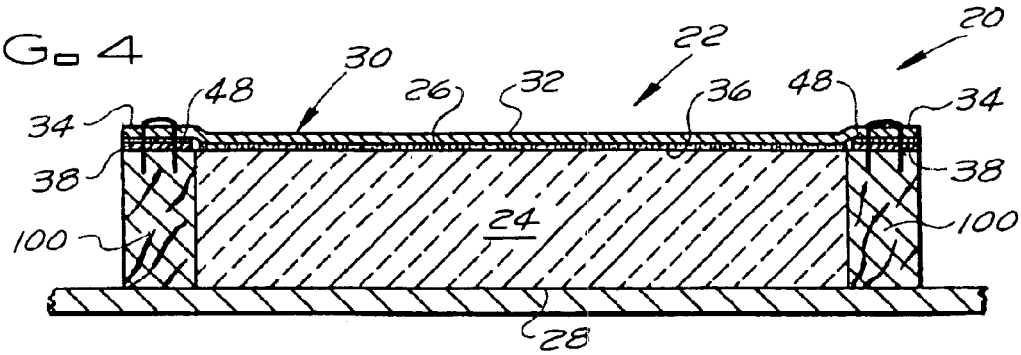
FIG. 4 is a schematic transverse cross section through the faced insulation assembly of FIG. 1 installed between two framing members by stapling the lateral tabs of the faced insulation assembly to inwardly facing end surfaces of the framing members.
Figure 5:
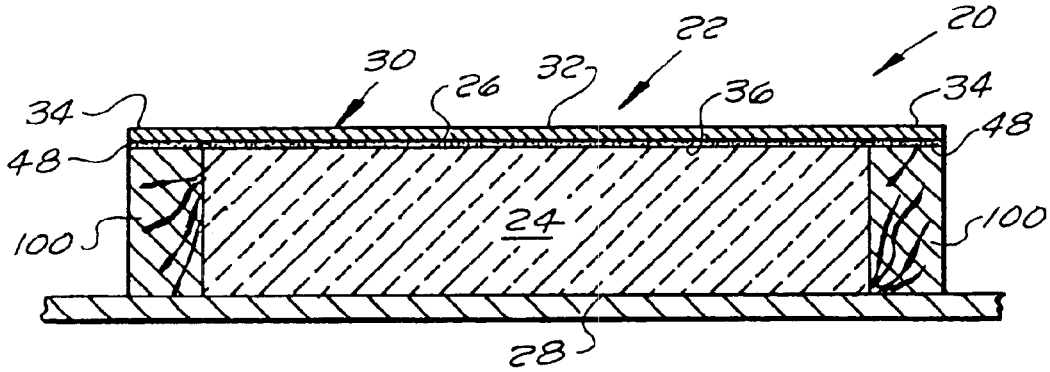
FIG. 5 is a schematic transverse cross section through the faced insulation assembly of FIG. 1 installed between two framing members by adhesively bonding the lateral tabs of the faced insulation assembly to inwardly facing end surfaces of the framing members.
Figure 6:
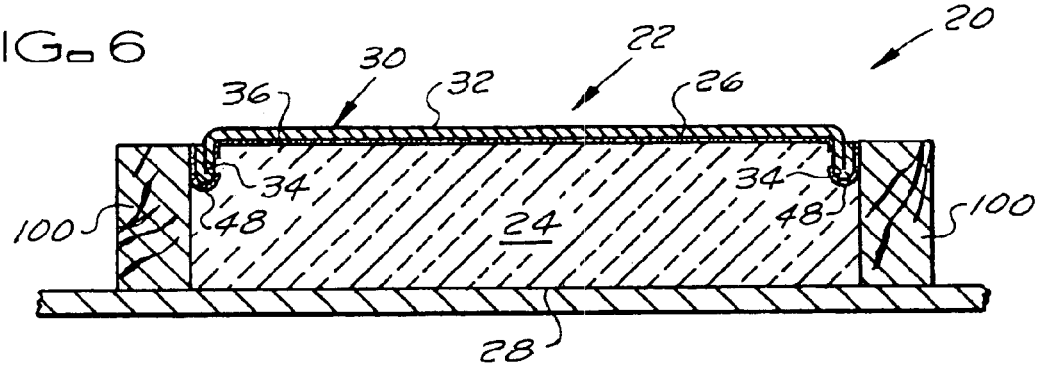
FIG. 6 is a schematic transverse cross section through the faced insulation assembly of FIG. 1 installed between two framing members by unfolding the lateral tabs from their initial folded positions and then folding and stapling or adhesively bonding the lateral tabs of the faced insulation assembly to lateral surfaces of the framing members.
Figure 7:
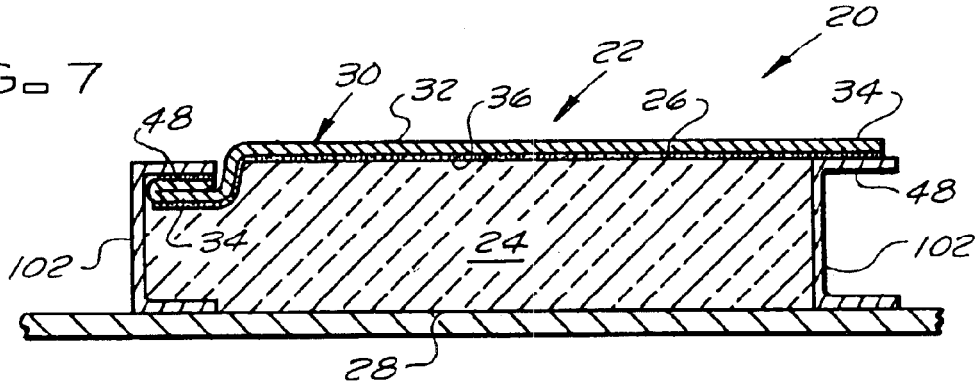
FIG. 7 is a schematic transverse cross section through the faced insulation assembly of FIG. 1 installed between two channel shaped framing members by adhesively bonding the lateral tabs of the faced insulation assembly to an inner surface of one of the frame members and an end surface of the other framing member.

When the faced insulation assembly 20 is installed, the lateral tabs 34 may be left in the folded position, unfolded for stapling to framing members 100, or, when a pressure-sensitive adhesive is used, the tab stripe may be removed from the lateral tabs 34 and one or both of the lateral tabs 34 may be unfolded and bonded to the framing members 100 or 102. The lateral tabs 34 may be used not only to secure the faced insulation assembly 20 to the framing members 100 or 102, but by forming a seal with and/or overlapping the framing members 100 and 102 with the lateral tabs 34 when the facing is being used as a water vapor retarder or barrier, the lateral tabs 34 help to assure that the facing 22 functions as a good air and/or water vapor retarder or barrier. FIG. 3 shows the faced insulation assembly 20 installed by press fitting the assembly in a laterally compressed state between two framing members 100 with the lateral tabs 34 in the folded state. In FIG. 3, the resilience of the insulation layer 24 causes the insulation layer to press against the lateral surfaces of the framing members 100 to hold the faced insulation assembly 20 in place between the framing members. FIG. 4 shows the faced insulation assembly 20 installed between two framing members 100 with the lateral tabs 34 unfolded, the tab strips 38 still adhered to the lateral tabs 34, and the lateral tabs 34 stapled to inwardly facing end surfaces of the framing members 100. FIG. 5 shows the faced insulation assembly 20 installed between two framing members 100 with the lateral tabs 34 unfolded, the tab strips 38 removed from the lateral tabs 34, and the lateral tabs 34 bonded to the inwardly facing end surfaces of the framing members 100. FIG. 6 shows the faced insulation assembly 20 installed between two framing members 100 with the lateral tabs 34 unfolded from their storage positions, the tab strips 38 removed, and the lateral tabs 34 then folded into U-shapes and bonded to the lateral surfaces of the framing members 100. FIG. 7 shows the faced insulation assembly 20 installed between two channel shaped framing members 102 with one of the lateral tabs 34 left in its original folded position, with its tab strip 38 removed, and bonded to an inner surface of one of the channel shaped framing members 102 and the other lateral tab 34 unfolded, with its tab strip 38 removed, and bonded to an inwardly facing end surface of the other framing member 102.

As discussed above, the insulation layer 24 of the faced insulation assembly 20 may be made of various insulating materials used in the building industry such as but not limited to foam insulation boards, fibrous insulation blankets, fibrous insulation boards (e.g. fiberglass insulation boards having densities between 1.6 and 12 pounds/ft$^3$), and other building insulation materials. However, a preferred insulation layer 24 utilized in the faced insulation assembly 20 is a resilient fibrous insulation blanket and while the fibrous insulation blanket may be made of other materials, preferably, the fibrous insulation blanket utilized in the faced insulation assembly 20 is a conventional uncut resilient fibrous insulation blanket or a pre-cut resilient fibrous insulation blanket made of randomly oriented, entangled, glass fibers that, typically, has a density between about 0.3 pounds/ft$^3$ and about 1.6 pounds/ft$^3$. Examples of fibers other than glass fibers that may be used to form the fibrous insulation blanket of the insulation layer 24 are mineral fibers, such as but not limited to, rock wool fibers, slag fibers, and basalt fibers; natural fibers such as but not limited to hemp, kenaf, and cotton; and organic fibers such as but not limited to polypropylene, polyester and other polymeric fibers. The fibers in the fibrous insulation blanket may be bonded together for increased integrity, e.g. by a binder at their points of intersection such as but not limited to urea phenol formaldehyde or other suitable bonding materials, or the fibrous insulation blanket may be binderless provided the blanket possess the required integrity and resilience.

While the preferred faced insulation assembly 20 may be a faced fibrous insulation blanket in roll form (typically in excess of 117 inches in length), for most applications, such as the insulation of walls in homes and other residential structures, the faced insulation assembly 20 is in the form of a faced fibrous insulation blanket (fibrous batt) about 46 to about 59 inches in length (typically about 48 inches in length) or 88 to about 117 inches in length (typically about 93 inches in length). Typically, the width of the insulation layer 24 of the faced insulation assembly 20 is substantially equal to or somewhat greater than a standard cavity width of the cavities to be insulated, for example: about 15 to about 15½ inches in width (a nominal width of 15 inches) for a cavity where the center to center spacing of the wall, floor, ceiling or roof framing members is about 16 inches (the cavity having a width of about 14½ inches); and about 23 to about 23½ inches in width (a nominal width of 23 inches) for a cavity where the center to center spacing of the wall, floor, ceiling or roof framing members is about 24 inches (the cavity having a width of about 22½ inches). However, for other applications, the insulation layer 24 of the faced insulation assembly 20 may have a different initial width determined by the standard width of the cavities to be insulated with the faced insulation assembly 20.

The amount of thermal resistance or sound control desired and the depth of the cavities being insulated with the faced insulation assembly 20 typically determine the thickness of insulation layer 24 of the faced insulation assembly 20 used for a particular application. Typically, the insulation layer 24 is from about two to about thirteen inches in thickness and approximates the depth of the cavities being insulated. For example, in a wall cavity defined in part by nominally 2×4 or 2×6 inch studs or framing members, an insulation layer 24 will have a thickness of about 3½ inches or about 5½ inches, respectively.

The facing materials used to form the sheet 30 of the facing 22 may include various sheet or paper like materials, such as but not limited to: coated kraft papers; foil-scrim-kraft laminates; polymeric film sheets such as but not limited to high density polyethylene, low density polyethylene, polypropylene and laminations or coextrusions thereof; nylon films; nonwoven spunbond or glass mats; nonwoven spunbond or glass mats bonded to polymeric films; or other facing materials. In addition, the facing materials may be imperforate or perforated to provide the facing material with a preselected permeance. Preferably, the facing materials are sufficiently pliable and deformable: a) to hold a fold or crease so that when lateral tabs 34 are formed in the facing material, the lateral tabs 34 retain their shape and can be folded substantially flat against the facing or insulation and will remain folded substantially flat against the facing or insulation to prevent damage to the lateral tabs during packaging, storage, shipment and handling; and b) to be easily unfolded or opened and extended while retaining their integrity for application to a framing member. Typically the facing 22 is between about 0.5 mils and about 4.0 mils in thickness. The lateral tabs 34 are typically between 1 and 2 inches in width, but for special applications the lateral tabs 34 tabs may be up to 8 inches in width. In addition, while the lateral tabs 34 have been shown as continuous tabs that extend continuously for the length of the insulation layer 24, it is contemplated that the lateral tabs 34 could be discontinuous. For certain applications, the facing material forming the sheet 30 exhibits a permeance of less than 1 grain/ft$^2$/hour/inch Hg (less than 1 perm) to provide a vapor retarder or barrier for the faced fibrous insulation blanket, e.g. a faced resilient fiberglass insulation blanket, and for other applications, the facing material forming the sheet 30 exhibits a permeance of more than 1 grain/ft$^2$/hour/inch Hg (more than 1 perm) and, preferably, more than 5 grains/ft$^2$/hour/inch Hg (more than 5 perm) to provide a porous facing for the faced fibrous insulation blanket.

The two lateral tabs 34 are joined to the central field portion 32 of the sheet 30 along fold lines 40. As shown in FIGS. 1 and 2, the lateral tabs 34 are folded back to overlay the central field portion 32 of sheet 30 for packaging, shipping, and handling to prevent damage to the lateral tabs 34. The fold lines 40 joining the lateral tabs 34 to the central field portion 32 of the sheet 30 may include laser etched or mechanically formed score lines 42 (see FIGS. 8 and 9) that are formed in the outer surface of the sheet 30 and coincide with and extend along the lengths of the fold lines 40 to help maintain the lateral tabs 34 in the folded position for packaging, shipping and handling. Where the sheet 30 is made of polymeric or other sheet materials that can be welded, weld lines 44 (see FIGS. 10 and 11), that extend along and adjacent the fold lines 40, may be used to separably bond first sides of the lateral tabs 34, that oppose the outer surface of the central field portion 32 of the sheet 30, to the outer surface of the central portion 32 of the sheet 30 to help maintain the lateral tabs 34 in the folded position for packaging, shipping, and handling.

The materials used to form the tab strips 38 may include various sheet or paper like materials, such as but not limited to: coated kraft papers; foil-scrim-kraft laminates; polymeric film sheets such as but not limited to high density polyethylene, low density polyethylene, polypropylene and laminations or coextrusions thereof; nylon films; nonwoven spunbond or glass mats; nonwoven spunbond or glass mats bonded to polymeric films; or other facing materials.

Figure 8:
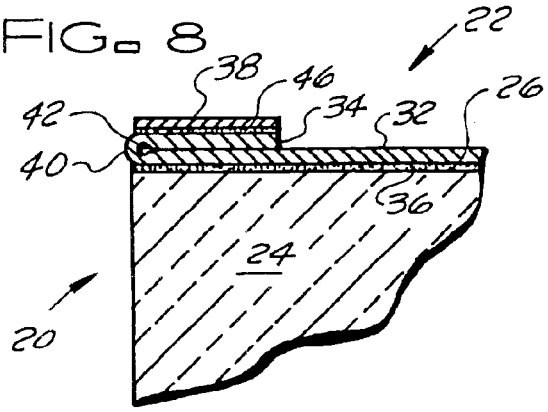
FIG. 8 is an enlarged schematic partial transverse cross section of a first embodiment of the faced insulation assembly of FIGS. 1 and 2 to better show one of the lateral tabs in its folded state.
Figure 9:
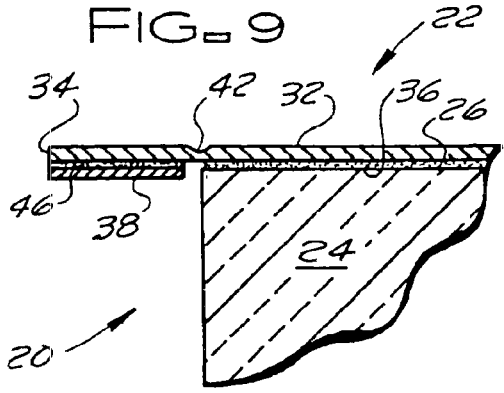
FIG. 9 is an enlarged schematic partial transverse cross section of the faced insulation assembly of FIG. 8 to show one of the lateral tabs unfolded and ready for stapling to a framing member.

The tab strips 38 are coextensive with or essentially coextensive with and bonded to second surfaces of the lateral tabs 34 that face away from the central field portion 32 of the sheet 30 when the lateral tabs 34 are in their folded state. The tab strips 38 may be permanently bonded to the second surfaces of the lateral tabs 34, e.g. by an adhesive layer 46, as shown in FIGS. 8 and 9. When the faced insulation assembly 20 of the embodiment of FIGS. 8 and 9 is installed in a cavity formed between two framing members 100, the lateral tabs 34 may be left in the folded position as shown in FIGS. 3 and 8 or unfolded, extended, and for stapling to the framing members 100 as shown in FIGS. 4 and 9.

Figure 10:
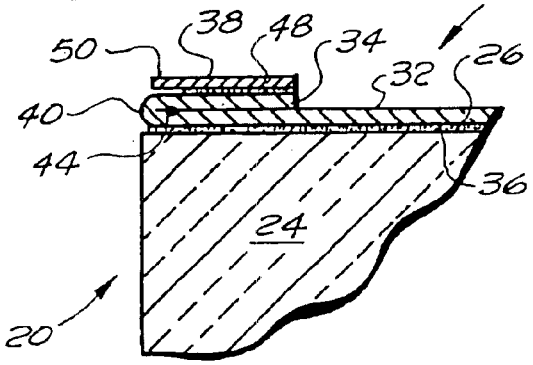
FIG. 10 is an enlarged schematic partial transverse cross section of a second embodiment of the faced insulation assembly of FIGS. 1 and 2 to better show one of the lateral tabs in its folded state.
Figure 11:
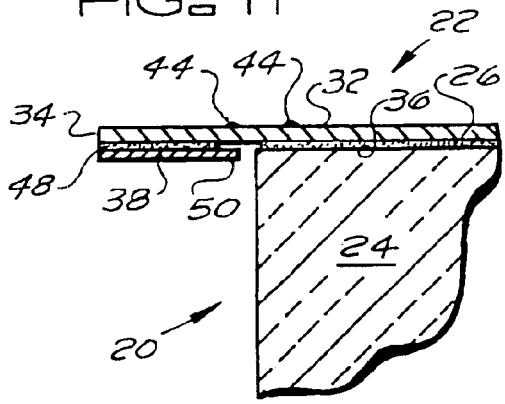
FIG. 11 is a schematic partial transverse cross section of the second embodiment of the faced insulation assembly showing the lateral tab unfolded and ready for stapling to a framing member.
Figure 12:
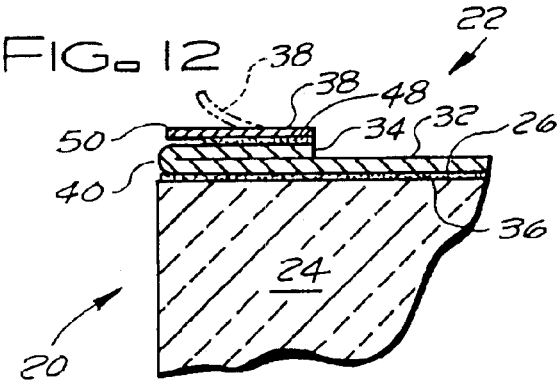
FIG. 12 is a schematic partial transverse cross section of the second embodiment of the faced insulation assembly showing the lateral tab in its folded state with the tab strip overlaying the pressure-sensitive adhesive on the tab and, in phantom line, being removed to expose pressure-sensitive adhesive on the tab for bonding to a framing member.
Figure 13:
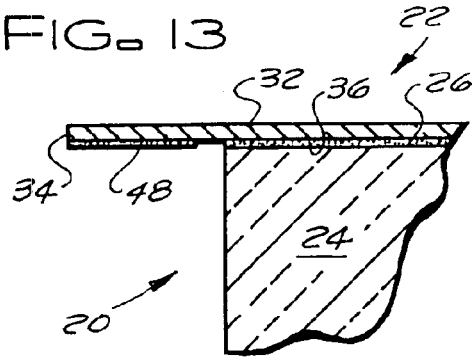
FIG. 13 is an enlarged schematic partial transverse cross section of the second embodiment of the faced insulation assembly showing the tab strip removed from the lateral tab and the lateral tab unfolded and ready for bonding to a framing member.

As shown in the embodiment of FIGS. 10 to 13, the tab strips 38 also function as release liners that are coated with a release agent and separably bonded to the second surfaces of the lateral tabs 34 by a pressure sensitive adhesive layer 48. When the faced insulation assembly 20 of the embodiment of FIGS. 10 to 13 is installed in a cavity formed between two framing members 100, the lateral tabs 34 may be: left in the folded position as shown in FIG. 10 and installed as shown in FIG. 3; unfolded for stapling the lateral tabs to framing members as shown in FIG. 11 and stapled to the framing members as shown in FIG. 4; unfolded with the tab strips 38 removed for bonding the lateral tabs to framing members as shown in FIGS. 12 and 13 and bonded to the framing members as shown in FIG. 5; unfolded with the tab strips removed as shown in FIGS. 12 and 13 and then folded into U-shapes and bonded to the lateral surfaces of the framing members as shown in FIG. 6 or unfolded as shown in FIGS. 10 and 11, then folded into U-shapes and stapled to the lateral surfaces of the framing members. When the embodiment of FIGS. 10 to 13 is installed in a cavity formed between two channel shaped framing members 102, one of the lateral tabs 34 is left in its original folded position as shown in FIG. 10, with its tab strip 38 removed, and bonded to an inner surface of one of the channel shaped framing members 102 as shown in FIG. 7 and the other lateral tab 34 unfolded, with its tab strip 38 removed as shown in FIGS. 12 and 13, and bonded to an inwardly facing end surface of the other framing member 102. In the embodiment of the faced insulation assembly 20 of FIGS. 10 to 13, the tab ships 38 preferably have a flap 50 that can be more easily gripped to facilitate the removal of the tab strips 38 from the pressure-sensitive adhesive 48 on the lateral tabs as shown in FIG. 12 to expose the pressure-sensitive adhesive 48 for application to the framing members 100 or 102.

Preferably, the pressure-sensitive adhesive will adhere well to both wooden and metal framing members. An example of a pressure-sensitive adhesive that may be used for the adhesive 48 is a hot melt pressure-sensitive adhesive sold by Bostick Findley of Wisconsin under the trade designation 2279 hot melt pressure sensitive adhesive. The hot melt pressure-sensitive adhesive may be modified with flame retardant additives, such as but not limited to pentabromyl and diphenyl oxide. Other examples of pressure sensitive adhesives that adhere well to both wood and metal surfaces are double stick tapes sold under the trade designations "Compac 251" and "Compac 351" by Compac Industries, Inc. of Edison, N.J. A compatible release agent is used on the surface of the tab strip 38, e.g. silicone or some other conventional release agent, to facilitate the removal of the tab strip 38 from the lateral tabs 34 for the application of the lateral tabs to the framing members 100 or 102.

Figure 14:
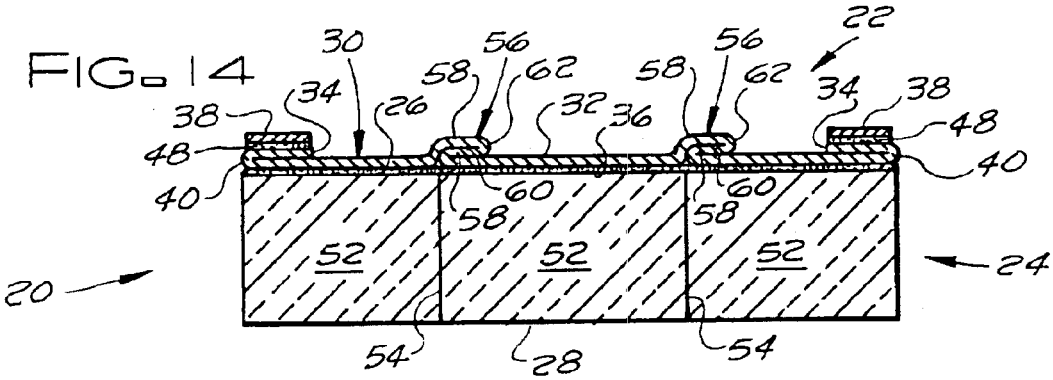
FIG. 14 is a transverse cross section through an embodiment of a faced insulation assembly of the subject invention wherein both the insulation layer and the facing are longitudinally separable to form faced insulation assembly sections having lesser widths than the faced insulation assembly and the facing includes tabs in the field portion of the facing sheet.

FIG. 14 shows an embodiment of the faced insulation assembly 20 wherein both the facing 22 and the insulation layer 24 are longitudinally separable to form faced insulation sections 52 having lesser widths than the faced insulation assembly 24. The insulation layer 24 has one or more longitudinally extending series of cuts and separable connectors, schematically represented by lines 54, which enable the insulation layer 24 to be separated into the insulation sections 52 of lesser widths than the insulation layer 24. For each such series of cuts and separable connectors 54 in the insulation layer 24, the field portion 32 of the sheet 30 forming the facing 22 has a Z-shaped fold 56 therein that is longitudinally aligned with the series of cuts and separable connectors. The segments 58 of each Z-shaped fold 56 are separably bonded to each other by a pressure sensitive adhesive 60 and, typically, the fold line 62 joining the segments 58 will be perforated, scored, or otherwise weakened to facilitate the separation of the tab segments 58 along the fold line 62. Other than the one or more series of cuts and separable connectors 54 and the one or more Z-shaped folds 56, the faced insulation assembly of FIG. 14 is the same as the faced insulation assembly of FIGS. 1 to 11.

Figure 15:
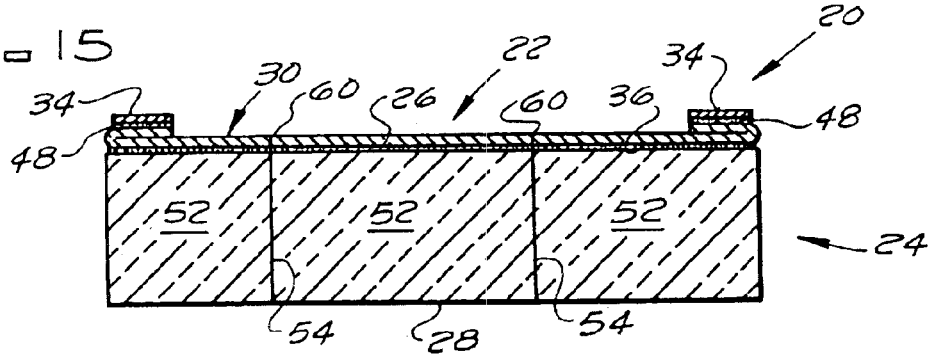
FIG. 15 is a transverse cross section through an embodiment of a faced insulation assembly of the subject invention wherein both the insulation layer and the facing are longitudinally separable to form faced insulation assembly sections having lesser widths than the faced insulation assembly, but the facing sheet does not include tabs in the field portion of the facing sheet.

FIG. 15 shows an embodiment of the faced insulation assembly 20 wherein both the facing 22 and the insulation layer 24 are longitudinally separable to form faced insulation sections 52 having lesser widths than the faced insulation assembly 24. The insulation layer 24 has one or more longitudinally extending series of cuts and separable connectors, schematically represented by lines 54, which enable the insulation layer 24 to be separated into the insulation sections 52 of lesser widths than the insulation layer 24. For each such series of cuts and separable connectors 54 in the insulation layer 24, the field portion 32 of the sheet 30 forming the facing 22 has a line of weakness 60 therein that is longitudinally aligned with the series of cuts and separable connectors. The line of weakness 60 may be formed as a perforated line, as an etched score line that reduces the thickness of the sheet material along the line, or the line may be otherwise weakened to facilitate the separation of the facing sheet along the line 60. Other than the one or more series of cuts and separable connectors 54 and the one or more lines of weakness 60, the faced insulation assembly of FIG. 15 is the same as the faced insulation assembly of FIGS. 1 to 11.

In describing the invention, certain embodiments have been used to illustrate the invention and the practices thereof. For example, while the insulation assemblies of the subject invention have only been shown secured to dimensional lumber frame members and channel shaped frame members, the insulation assemblies of the subject invention can also be secured I-joists or I-beans, trusses, and other framing members not shown. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A facing for a faced insulation assembly, comprising:

a sheet having a length and a width; the sheet being made of a porous sheet material having a permeance of greater than 5 perms;

the sheet having a central field portion for overlaying and being bonded to a major surface of an insulation layer, the central field portion of the sheet having a first major surface and a second major surface; the second major surface of the central field portion of the sheet having an adhesive thereon for bonding the sheet to a major surface of an insulation layer; and the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; and each lateral tab having a tab strip bonded to a second surface of the tab that provides the tab with increased integrity.

2. The facing for a faced insulation assembly according to claim 1, including:

means for helping maintain each lateral tab in the folded position overlaying the first major surface of the central field portion of the sheet during handling.

3. The facing for a faced insulation assembly according to claim 2, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

4. The facing for a faced insulation assembly according to claim 2, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

5. The facing for a faced insulation assembly according to claim 1, wherein:

the tab strips bonded to the lateral tabs are release liners; and the tab strips are bonded to the second surfaces of the lateral tabs by a pressure-sensitive adhesive whereby the lateral tabs may be left in the folded position, unfolded for stapling to framing members, or unfolded with the tab strips removed for bonding to framing members.

6. The facing for a faced insulation assembly according to claim 5, including:

means for helping maintain each lateral tab in the folded position overlaying the first major surface of the central field portion of the sheet during handling.

7. The facing for a faced insulation assembly according to claim 6, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

8. The facing for a faced insulation assembly according to claim 6, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

9. The facing for a faced insulation assembly according to claim 1, wherein:

the field portion of the sheet includes a Z-fold spaced inwardly from and extending parallel to the lateral tabs; and the field portion of the sheet is separable longitudinally along the Z-fold.

10. The facing for a faced insulation assembly according to claim 1, wherein: the field portion of the sheet includes a line of weakness spaced inwardly from and extending parallel to the lateral tabs; and the field portion of the sheet is separable longitudinally along the line of weakness.

11. A faced insulation assembly, comprising:

an insulation layer, the insulation layer having a length, a width and a thickness; the insulation layer having first and second major surfaces defined by the length and width of the layer;

a sheet having a length and a width; the sheet being made of a porous sheet material having a permeance of greater than 5 perms;

the sheet having a central field portion overlaying the first major surface of the insulation layer, the central field portion of the sheet having a first major surface and a second major surface; the second major surface of the central field portion of the sheet having an adhesive thereon bonding the sheet to the first major surface of the insulation layer; and the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; each lateral tab having a tab strip bonded to a second surface of the tab that provides the tab with increased integrity; and each lateral tab, when unfolded, extending laterally beyond the first major surface of the insulation layer for attachment to a framing member.

12. The faced insulation assembly according to claim 11, including:

means for helping maintain each lateral tab in the folded position overlaying the first major surface of the central field portion of the sheet during handling.

13. The faced insulation assembly according to claim 12, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

14. The faced insulation assembly according to claim 12, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

15. The faced insulation assembly according to claim 11, wherein:

the tab strips bonded to the lateral tabs are release liners; and the tab strips are bonded to the second surfaces of the lateral tabs by a pressure-sensitive adhesive whereby the lateral tabs may be left in the folded position, unfolded for stapling to framing members, or unfolded with the tab stripe removed for bonding to framing members.

16. The faced insulation assembly according to claim 15, including:

means for helping maintain each lateral tab in the folded position overlaying the first major surface of the central field portion of the sheet during handling.

17. The faced insulation assembly according to claim 16, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

18. The faced insulation assembly according to claim 16, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

19. The faced insulation assembly according to claim 11, wherein:

the insulation layer is separable longitudinally intermediate lateral edges of the insulation layer along separable connector means; and the field portion of the sheet includes a Z-fold spaced inwardly from and extending parallel to the lateral tabs that is aligned with separable connector means; and the field portion of the sheet is separable longitudinally along the Z-fold.

20. The faced insulation assembly according to claim 11, wherein:

the insulation layer is separable longitudinally intermediate lateral edges of the fibrous insulation blanket along a separable connector means; and the field portion of the sheet includes a line of weakness spaced inwardly from and extending parallel to the lateral tabs that is aligned with the separable connector means; and the field portion of the sheet is separable longitudinally along the line of weakness.

21. The faced insulation assembly according to claim 11, wherein:

the insulation layer is a fibrous insulation blanket.

22. A facing for a faced insulation assembly, comprising:

a sheet having a length and a width;

the sheet having a central field portion for overlaying and being bonded to a major surface of an insulation layer the central field portion of the sheet having a first major surface and a second major surface; the second major surface of the central field portion of the sheet having an adhesive thereon for bonding the sheet to a major surface of an insulation layer;

the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; and each lateral tab having a tab strip bonded to a second surface of the tab by a pressure-sensitive adhesive that is overlayed by the tab strip; and the tab strips being release liners that increase the integrity of the lateral tabs and enable the lateral tabs to be left In the folded position, unfolded with the tab strips remaining in place on the lateral tabs when the lateral tabs are to be stapled to framing members, or unfolded with the tab strips removed when the lateral tabs are to be bonded to framing members; and means for helping to maintain each of the lateral tabs in the folded position overlaying the first major surface of the central field portion of the sheet during handling.

23. A faced insulation assembly, comprising:

an insulation layer, the insulation layer having a length, a width and a thickness; the insulation layer having first and second major surfaces defined by the length and width of the layer;

a sheet having a length and a width;

the sheet having a central field portion overlaying the first major surface of the insulation layer, the central field portion of the sheet having a first major surface and a second major surface; the second major surface of the central field portion of the sheet having an adhesive thereon bonding the sheet to the first major surface of the insulation layer; and the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; and each lateral tab having a tab strip bonded to a second surface of the tab by a pressure-sensitive adhesive that is overlayed by the tab strip; and the tab strips being release liners that increase the integrity of the lateral tabs and enable the lateral tabs may be left in the folded position, unfolded with the tab strips remaining in place on the lateral tabs when the lateral tabs are to be stapled to framing members, or unfolded with the tab strips removed when the lateral tabs are to be bonded to framing members; and means for helping to maintain each of the lateral tabs in the folded position overlaying the first major surface of the central field portion of the sheet during handling.

24. A facing for a faced insulation assembly, comprising:

a sheet having a length and a width; the sheet being made of a sheet material having a permeance of greater than 1 perm;

the sheet having a central field portion for overlaying and being bonded to a major surface of an insulation layer; the central field portion of the sheet having a first major surface and a second major surface; the second major surface of the central field portion of the sheet having an adhesive thereon for bonding the sheet to a major surface of an insulation layer;

the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; and each lateral tab having a tab strip bonded to a second surface of the tab that provides the tab with increased integrity; the tab strips bonded to the lateral tabs being release liners; and the tab strips being bonded to the second surfaces of the lateral tabs by a pressure-sensitive adhesive whereby the lateral tabs may be left in the folded position, unfolded for stapling to framing members, or unfolded with the tab strips removed for bonding to framing members.

25. The facing for a faced insulation assembly according to claim 24, including:

means for helping maintain each lateral tab in the folded position overlaying the first major surface of the central field portion of the sheet during handling.

26. The facing for a faced insulation assembly according to claim 25, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

27. The facing for a faced insulation assembly according to claim 25, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

28. A faced insulation assembly, comprising:

an insulation layer, the insulation layer having a length, a width and a thickness; the insulation layer having first and second major surfaces defined by the length and width of the layer, a sheet having a length and a width; the sheet being made of a sheet material having a permeance of greater than 1 perm;

the sheet having a central field portion overlaying the first major surface of the insulation layer, the central field portion of the sheet having a first major surface and a second major surface; the second major surface of the central field portion of the sheet having an adhesive thereon bonding the sheet to the first major surface of the insulation layer;

the sheet having first and second lateral tabs extending for the length of the sheet that are separated from each other by the central field portion of the sheet; each lateral tab being joined to the central field portion of the sheet along a fold line; each lateral tab being folded back to overlay the first major surface of the central field portion of sheet and having a first surface opposing the first major surface of the central field portion of the sheet; and each lateral tab having a tab strip bonded to a second surface of the tab that provides the tab with increased integrity; the tab strips bonded to the lateral tabs being release liners; the tab strips being bonded to the second surfaces of the lateral tabs by a pressure-sensitive adhesive; and each lateral tab, when unfolded, extending laterally beyond the first major surface of the insulation layer for attachment to a framing member whereby the lateral tabs may be left in the folded position, unfolded for stapling to framing members, or unfolded with the tab strips removed for bonding to framing members.

29. The faced insulation assembly according to claim 28, including:

means for helping maintain each lateral tab in the folded position overlaying the first major surface of the central field portion of the sheet during handling.

30. The faced insulation assembly according to claim 29, wherein:

the means for helping maintain each lateral tab in the folded position overlaying the first major surface of the central field portion of the sheet during handling are score lines in the first major surface of the sheet that coincide with and extend along the fold lines joining the lateral tabs to the central field portion of the sheet.

31. The faced insulation assembly according to claim 29, wherein:

the means for helping maintain each lateral tab in the folded position overlaying the first major surface of the central field portion of the sheet during handling are weld lines extending along the fold lines joining the lateral tabs to the central field portion of the sheet that join the first surface of the tab to the first major surface of the field portion of the sheet.

* * * * *